US007353805B2

(12) United States Patent
Spoolstra

(10) Patent No.: US 7,353,805 B2
(45) Date of Patent: Apr. 8, 2008

(54) FUEL INJECTOR PUMP WITH TRAPPED VOLUME

(75) Inventor: Gregg R. Spoolstra, Byron Center, MI (US)

(73) Assignee: Robert Bosch GmbH, Stuttgart (DE)

( * ) Notice: Subject to any disclaimer, the term of this patent is extended or adjusted under 35 U.S.C. 154(b) by 32 days.

(21) Appl. No.: 10/543,935

(22) PCT Filed: Jan. 30, 2003

(86) PCT No.: PCT/US03/02743

§ 371 (c)(1),
(2), (4) Date: Mar. 17, 2006

(87) PCT Pub. No.: WO2004/070190

PCT Pub. Date: Aug. 19, 2004

(65) Prior Publication Data

US 2006/0162696 A1 Jul. 27, 2006

(51) Int. Cl.
*F02M 57/02* (2006.01)
*F02M 63/00* (2006.01)

(52) U.S. Cl. ..... 123/446; 123/447; 123/496

(58) Field of Classification Search ..... 123/446, 123/447, 506, 496, 467
See application file for complete search history.

(56) References Cited

U.S. PATENT DOCUMENTS 3,592,568 A * 7/1971 Fenne ..... 417/430
3,762,379 A * 10/1973 Hobo et al. ..... 123/447
4,161,161 A * 7/1979 Bastenhof ..... 123/447
4,211,203 A 7/1980 Kobayashi
4,593,668 A 6/1986 Yuzawa
4,811,715 A * 3/1989 Djordjevic et al. ..... 123/447
4,881,504 A * 11/1989 Best ..... 123/447
4,951,631 A * 8/1990 Eckert ..... 123/446
5,086,742 A 2/1992 Vogtmann
5,195,487 A * 3/1993 Zurner et al. ..... 123/300
5,363,824 A * 11/1994 Bonse ..... 123/506
5,427,066 A * 6/1995 Buckley et al. ..... 123/179.17
5,445,323 A * 8/1995 Perr et al. ..... 239/91
5,642,714 A * 7/1997 Buckley ..... 123/447
6,763,809 B2 * 7/2004 Grabandt ..... 123/467
7,066,151 B1 * 6/2006 Bos ..... 123/467
2001/0027778 A1 10/2001 Schwarz

* cited by examiner

*Primary Examiner*—Thomas Moulis
(74) *Attorney, Agent, or Firm*—McGarry Bair PC

(57) ABSTRACT

A pumping system (10) for a fuel injection system including a pump body defining a pumping chamber, a plunger (14), a high-pressure outlet, a high-pressure fluid line (18) connecting the pumping chamber to the outlet and a trapped volume (20) in communication with either the fluid line (18) or the pumping chamber.

21 Claims, 7 Drawing Sheets

FUEL INJECTOR PUMP WITH TRAPPED VOLUME

CROSS-REFERENCE TO RELATED APPLICATIONS

This application claims priority on International Application No. PCT/US03/02743, filed Jan. 30, 2003.

BACKGROUND OF THE INVENTION

1. Field of the Invention

This invention relates to pump systems for fuel injection systems.

2. Description of the Related Art

Fuel injection systems for diesel engines typically utilize pumps that are cam driven, usually in synchronization with the drive shaft. Consequently, the highest fuel pressure generated at the pump typically occurs at maximum engine speed and load. Lower pressures occur at lower engine speeds and loads. Lower fuel pressures during an injection cycle can result in inefficiencies during injection, resulting in increased emissions and lower power output. It has long been desirable to increase injection pressure at lower engine loads.

Various solutions have been presented, including design changes with respect to nozzle flow, cam phasing, plunger diameter, and plunger velocity among others. For example, increasing plunger diameter can noticeably increase injection pressure at lower engine speeds. A common problem remains, however, and that is that increasing pressure at lower engine speeds also necessarily increases pressure at higher engine speeds. Currently operating pressures at higher speeds are at or near the maximum structural limits of the materials from which the pumps and valve bodies are made, on the order of 29,000 psi (2000 bar). Operating at higher pressures, as would be the case at higher engine speeds and loads, risks failure of the structural components.

There remains a need to control the maximum internal pressure within the injector when the engine is under full load or running at higher speeds.

SUMMARY OF THE INVENTION

This and other problems are solved by the present invention of an improvement in a pump system for a fuel injection system in a diesel engine where the fuel injection system has a control valve to control a fuel injection event. The pump system has a pump body defining a pumping chamber, a plunger disposed in the pumping chamber for pressurizing fuel, an outlet, and a fluid line connecting the pumping chamber to the outlet. According to the invention, a trapped volume is selectively in fluid communication with the pumping chamber or the fluid line, and a valve arrangement distinct from the control valve controls communication to the trapped volume. With this invention, higher pressures can be achieved at lower engine speed and maximum pressures can be controlled at higher engine speed.

In one aspect of the invention, the valve arrangement comprises a valve actuatable by fuel supply pressure. In another aspect of the invention, the valve arrangement comprises a valve actuatable by a solenoid actuator. One embodiment has the valve arrangement comprising a channel in the plunger. In this last embodiment, the trapped volume is an annulus formed in the pump body around the pumping chamber. The channel is located to establish fluid communication between the trapped volume and the plunger chamber as the plunger reciprocates between a retracted position and an extended position. Fluid communication is established as the plunger approaches the extended position.

Preferably, the valve arrangement comprises a spool valve. The valve arrangement can operate as a pressure-balanced valve. Preferably, the trapped volume is about 500 $mm^3$.

In another aspect of the invention, a method of controlling the maximum pressure in a pump system for a fuel injector in a diesel engine is shown where the fuel injector has a control valve to control a fuel injection event. Here, the pump system comprises a pump body defining a pumping chamber, a plunger disposed in the pumping chamber for pressurizing fuel, an outlet, and a fluid line connecting the pumping chamber to the outlet. The method is characterized by establishing communication between the pumping chamber or the fluid line and a trapped volume by a valve arrangement distinct from the control valve as the plunger approaches an extended position. Additionally, a valve arrangement is used to control the communication between the pumping chamber or the fluid line and the trapped volume.

DESCRIPTION OF THE PREFERRED EMBODIMENTS

Figure 1:
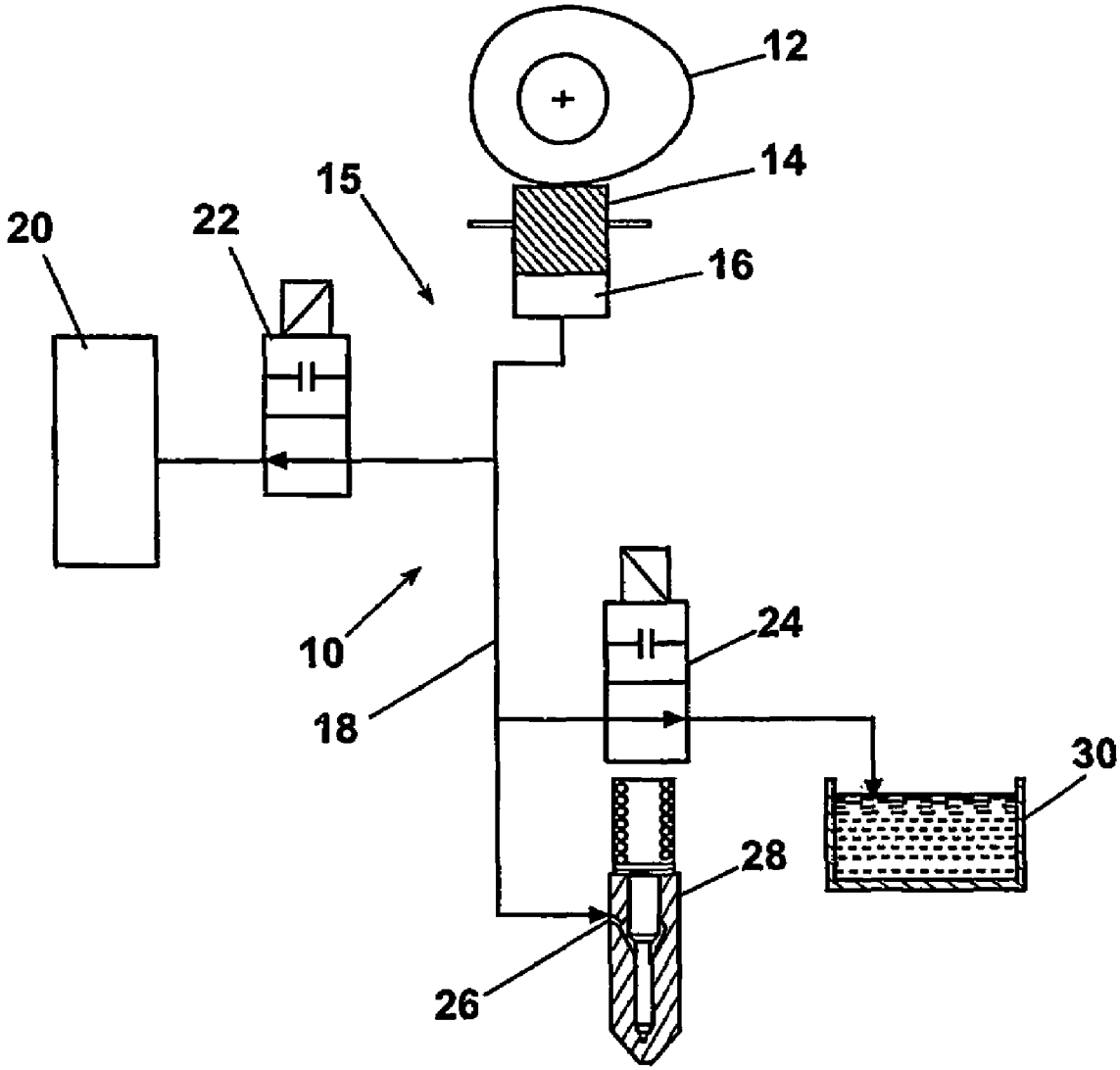
FIG. 1 is a schematic diagram of a fuel injector pump system incorporating the invention.
Figure 2:
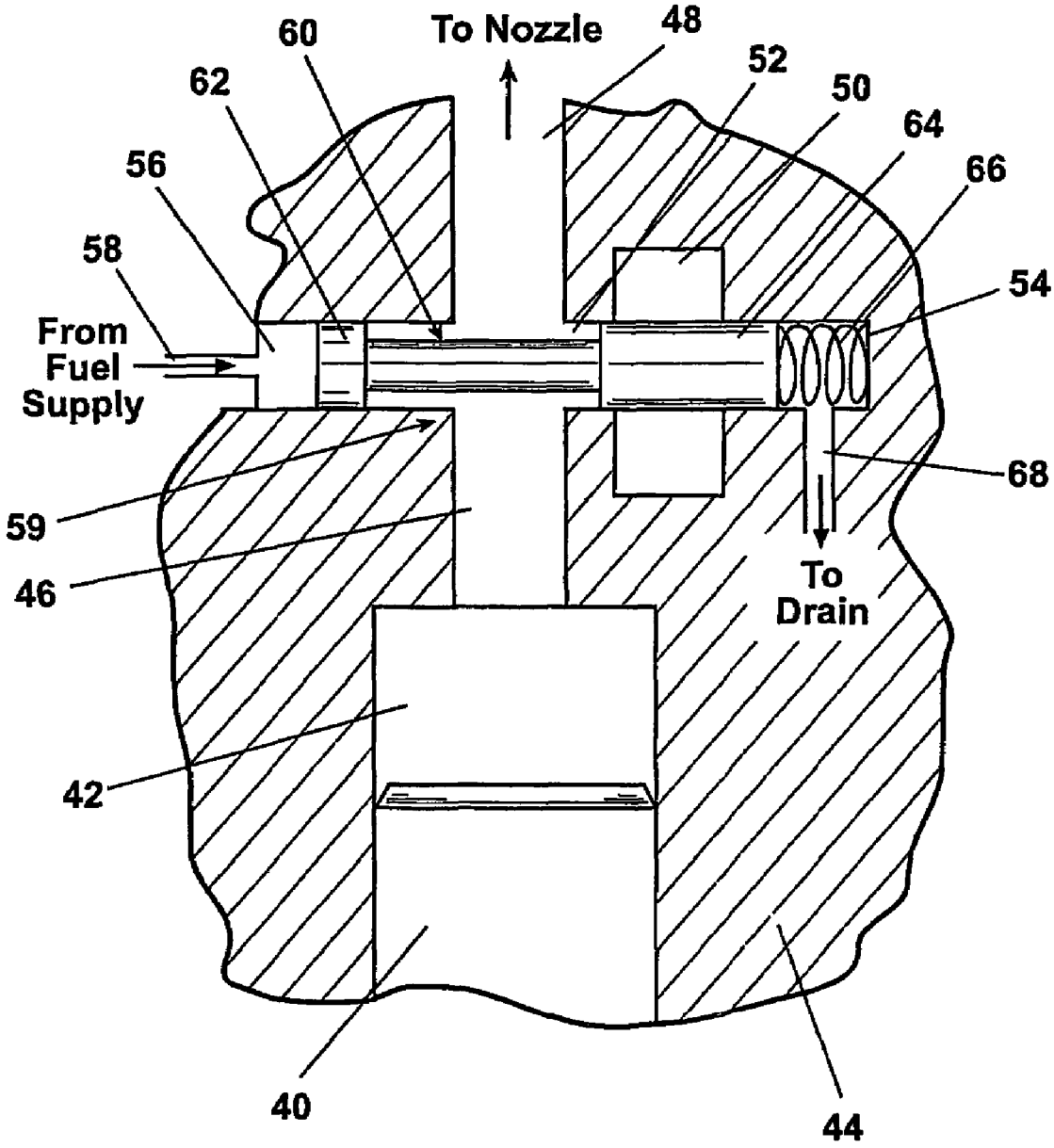
FIG. 2 is a side elevation in cross section of a portion of a fuel injector pump in accordance with the invention.
Figure 3:
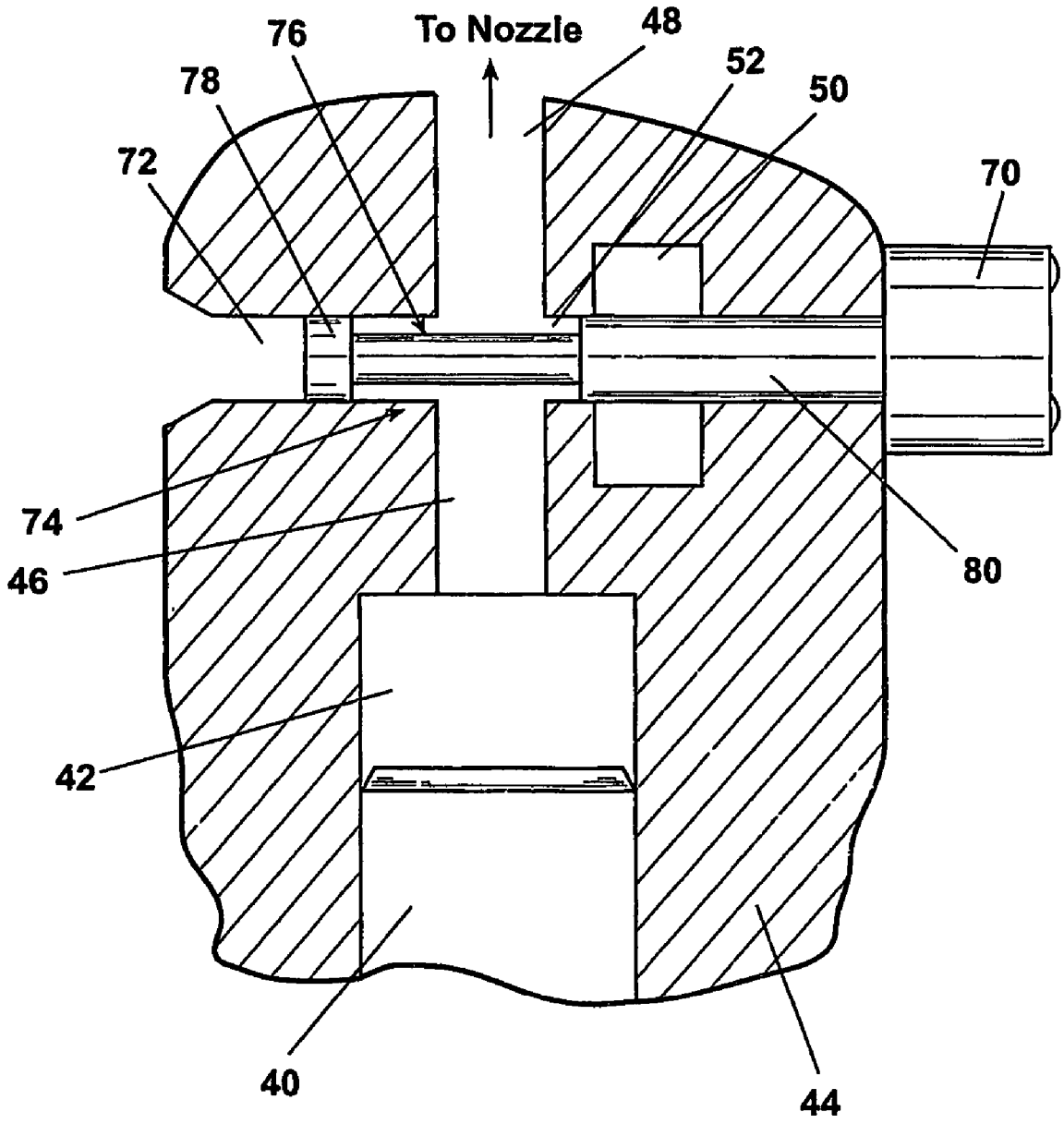
FIG. 3 is a side elevation in cross section of a second embodiment of a portion of a fuel injector pump in accordance with the invention.
Figure 4:
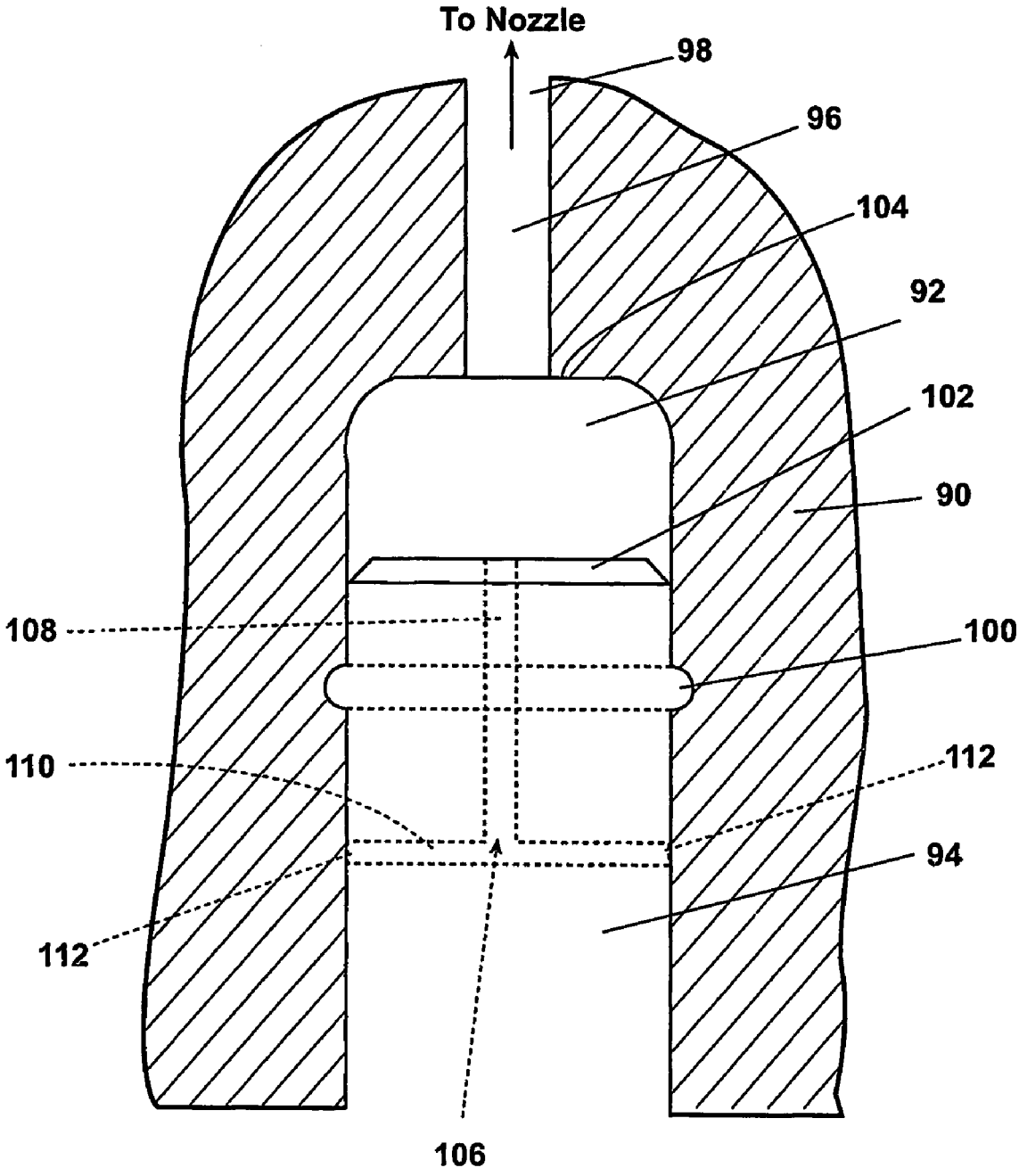
FIG. 4 is a side elevation in cross section of a third embodiment of a portion of a fuel injector pump in accordance with the invention.

A pump system for a fuel injection system is generally indicated schematically at 10, in FIG. 1. An engine driven cam 12 drives a plunger 14. The pumping chamber 16 of plunger 14 is connected to an injector via a high-pressure fluid line 18. The pump system may be a unit pump connected via a high-pressure fluid line to an injector, or alternatively, may be a unit injector. Further, it is appreciated that although an embodiment of the present invention is broadly illustrated in FIG. 1, the exemplary implementations in FIGS. 2-4 are included for illustration purposes. That is, there are many different ways to implement the present invention in accordance with the schematic illustration in FIG. 1.

With continuing reference to FIG. 1, a dead or trapped volume space is generally indicated at 20. It will be understood that the trapped volume 20 can be either associated with the plunger chamber 16, or the high pressure fluid line 18, but in any event, on the high pressure side of the pump system. The trapped volume 20 thus communicates either with the plunger chamber 16 or the fluid line 18, but the communication is controlled. When communication is open, the increased available volume reduces pressure on the high-pressure side, and when communication is closed the decreased available volume maintains a high pressure on the high side. Thus, when other steps are taken to increase pressure at lower engine speed and load, e.g. increasing the diameter of the plunger 14 or increasing the stroke velocity of the plunger, communication to the trapped volume 20 can be opened at higher engine speed and load to lower the maximum pressure from what would otherwise occur without the increase in volume. Control of fuel flow into the trapped volume 20 is by a valve arrangement 22. FIGS. 2-4 illustrate three different embodiments of valve arrangements for controlling communication with the trapped volume according to the invention.

With continuing reference to FIG. 1, a control valve 24 is disposed to route pressurized fuel from the pumping chamber 16 to the pumping system outlet 26, which in turn, connects to an injector 28 when the control valve 24 is closed. When the control valve 24 is open, fuel flow from the pumping chamber 16 bypasses the injector 28 to a low-pressure reservoir 30.

In FIG. 2, a first embodiment of the invention is illustrated. A plunger 40 reciprocates within a pumping chamber 42, all defined within a pump body 44. A fluid line 46 connects the pumping chamber 42 with an outlet 48, which, in turn, communicates with an injector nozzle (not shown) in conventional manner. Reciprocation of the plunger 40 is between a retracted position where fuel is delivered at low pressure to the pumping chamber 42, and an extended position where fuel in the pumping chamber 42 and the fluid line 46 is pressurized. Between the pumping chamber 42 and the outlet 48 is a trapped volume 50, in communication with the fluid line 46 by a bore 52. The bore 52 extends from the fluid line 46 to the trapped volume 50 and then to a wall 54. Another bore 56 extends in the other direction from the fluid line 46 to an inlet 58 in communication with the fuel supply (not shown). A valve arrangement 59 comprises a spool valve 60, having a first end 62 in the bore 56 and a second end 64 in the bore 52, spanning the fluid line 46. It is biased to a closed position (shown in FIG. 2) by a spring 66. The bore 52, past the trapped volume 50, has a drain outlet 68 that communicates with a low-pressure drain (not shown).

The spool valve 60 is pressure actuated by fuel supply pressure, whereby when pressure in the supply fuel acting on the first end 62 exceeds the force of the spring 66, the spool valve is urged to the right in FIG. 2. As it moves, the second end 64 opens communication of the trapped volume 50 to the fluid line 46 via the bore 52. This valve shift opens additional volume on the high side, temporarily reducing pressure as the additional volume is exposed, but eventually capping the maximum pressure at a level lower than it would have been had the trapped volume not been available.

FIG. 3 illustrates a second embodiment of the invention. Here components common to those of FIG. 2 bear like numerals. The plunger 40 reciprocates within the pumping chamber 42, all defined within the pump body 44. The fluid line 46 connects the pumping chamber 42 with the outlet 48, which, in turn, communicates with an injector nozzle (not shown) in a conventional manner. Between the pumping chamber 42 and the outlet 48 is the trapped volume 50, in communication with the fluid line 46 by the bore 52. The bore 52 extends from the fluid line 46 to the trapped volume 50 and then to a solenoid actuator 70. Another bore 72 extends in the other direction from the fluid line 46. A valve arrangement 74 comprises a spool valve 76, having a first end 78 in the bore 56 and a second end 80 in the bore 52, which spans the fluid line 46. The second end 80 engages the solenoid actuator 70. The spool valve 76 is biased to a closed position (shown in FIG. 3), typically by a spring in the actuator 70.

Here, when the solenoid actuator 70 is actuated, the spool valve 76 is urged to the right in FIG. 3. As it moves, the second end 80 opens communication of the trapped volume 50 to the fluid line 46 via the bore 52. This valve shift opens additional volume on the high side, temporarily reducing pressure as the additional volume is exposed, but eventually capping the maximum pressure at a level lower than it would have been had the trapped volume not been available.

FIG. 4 illustrates a third embodiment of the invention. A pump body 90 defines a pumping chamber 92 within which a plunger 94 reciprocates between a retracted position and an extended position. A high-pressure fluid line 96 connects the pumping chamber 92 to an outlet 98, which, in turn, communicates with an injector nozzle (not shown) in a conventional manner. An annulus in the wall of the pumping chamber 92 forms a trapped volume 100. The trapped volume 100 is located so that even in the retracted position, the plunger 94 still covers it. Thus, the trapped volume 100 is never exposed between the face 102 of the plunger 94 and the end wall 104 of the pumping chamber 92. Here a valve arrangement 105 is provided by a T-channel 106 formed in the plunger 94, having an axial portion 108 extending longitudinally within the plunger 94 from the face 102 to a radial portion 110 that in turn extends radially to ports 112 at the side of the plunger. The ports 112 are located so that when the plunger is in or near the extended position, they will be in communication with the trapped volume 100.

It will be understood that maximum pressure is achieved when the plunger 94 is in the extended position. In this embodiment, as the plunger 94 approaches its extended position, either at or slightly before achieving maximum pressure, the T channel 106 communicates with the trapped volume 100. This occurs as the ports 112 sweep past the trapped volume annulus 100, exposing the T-channel 106 to the trapped volume 100. The exposure of pressurized fuel in the pumping chamber 92 to the additional volume through the T-channel drops the pressure so that the maximum pressure is less than it would have been without the trapped volume. This embodiment is less flexible, but potentially lower in complexity and cost.

Figure 5:
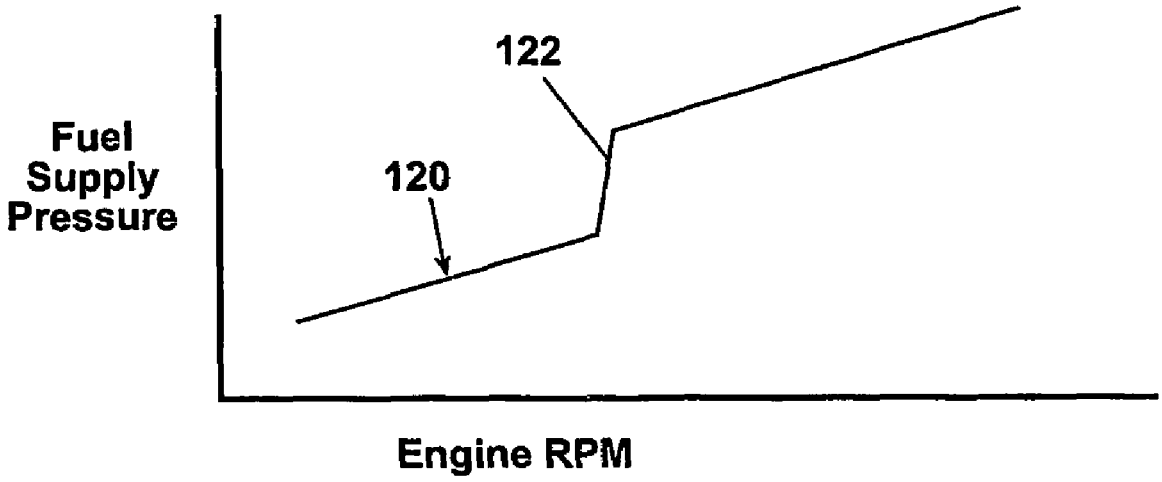
FIG. 5 is a chart comparing fuel supply pressure with engine RPM when the invention is operative.

FIG. 5 shows the change in fuel supply pressure needed against engine RPM in the embodiment of FIG. 2 where the fuel supply pressure drives the spool valve. Fuel supply pressure does not normally jump as illustrated, but with pressure relief valves or other controls on the fuel supply pump well know to those in the art, the increase in pressure can urge the spool valve 60 to shift. One can easily see that fuel supply pressure 120 jumps dramatically where the shift point 122 occurs, exposing the trapped volume to the high-pressure fuel.

Figure 6:
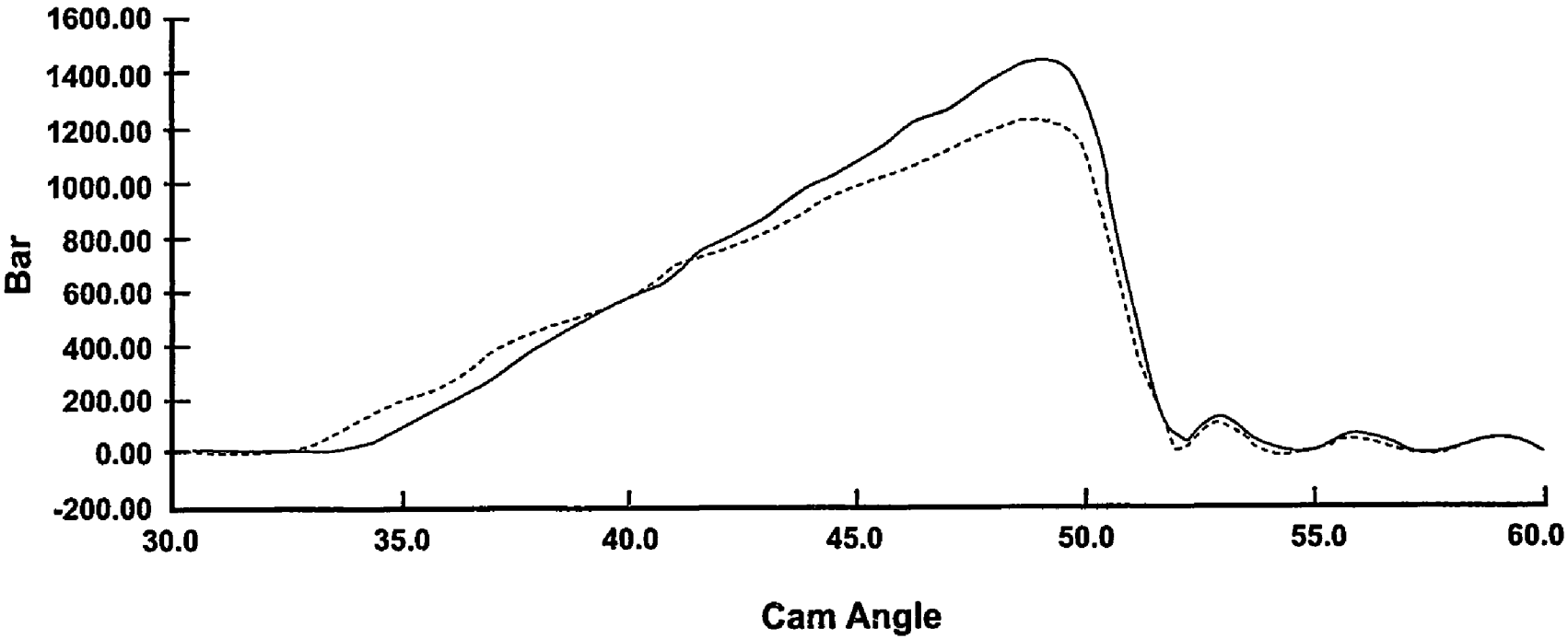
FIG. 6 is a chart showing the increase in pressure at lower engine speed with a larger plunger diameter.

FIG. 6 shows how increasing the diameter of the plunger can increase pressure at lower engine speeds. Plot 130 tracks pressure at the pumping chamber against the cam angle for an engine speed of 750 RPM where the plunger has a diameter of 10 mm. It can be seen that pressure maximum is about 1200 bar at peak torque. Plot 132 tracks pressure at the pumping chamber against the cam angle for an engine speed of 750 RPM where the plunger has a diameter of 11 mm. It can be seen that the pressure maximum is about 1410 bar at peak torque. Consequently it can be seen that increasing the plunger diameter 1 mm has the effect of increasing injection pressure over 10% at lower engine speeds.

Figure 7:
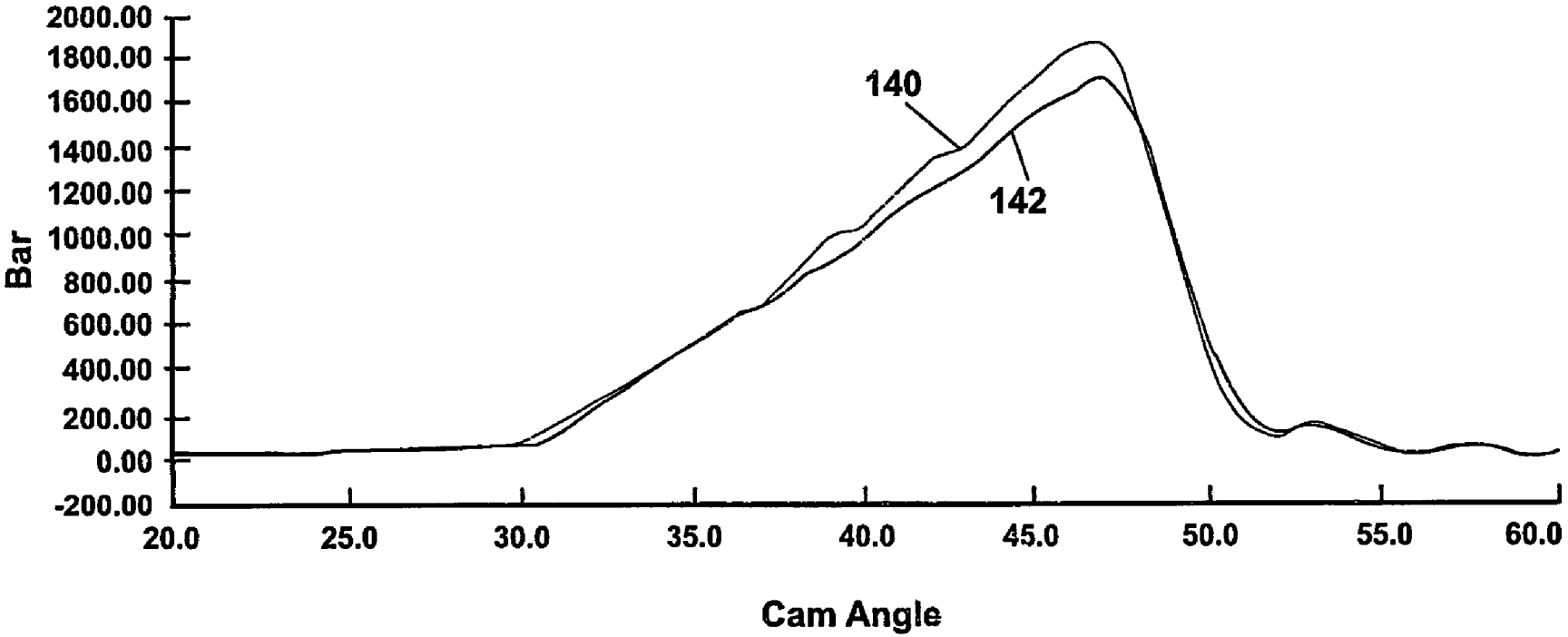
FIG. 7 is a chart showing the decrease in pressure at higher engine speed with an added trapped volume according to the invention.

Of course the problem presented by such a change is that pressure at the high end would also be increased, possibly jeopardizing the structural integrity of the pump. However, the benefits of the invention can be seen in FIG. 7 showing how maximum pressure is decreased at higher engine speeds by use of a trapped volume according to the invention. FIG. 7 plots pressure in the pumping chamber against cam angle for a plunger diameter of 11 mm with and without the trapped volume. Plot 140 tracks pressure without a trapped volume. It can be seen that maximum pressure peaks at 1894 bar. Plot 142 tracks pressure with a trapped volume 500 $mm^3$. It can be seen that maximum pressure peaks at 1690 bar. Thus, it will be apparent that with a pressure increase of 210 bar at a lower speed, the maximum pressure at a higher speed can be over 200 bar less than it would have been without the invention.

While the invention has been specifically described in connection with certain specific embodiments thereof, it is to be understood that this is by way of illustration and not of limitation, and the scope of the appended claims should be construed as broadly as the prior art will permit.

I claim:

1. A pump system for a fuel injection system in a diesel engine, the fuel injection system having a control valve to control commencement and termination of a fuel injection event, and the pump system having:

a pump body defining a pumping chamber;

a plunger disposed in the pumping chamber for pressurizing fuel;

an outlet; and a fluid line connecting the pumping chamber to the outlet; characterized by:

a trapped volume in fluid communication with the pumping chamber or the fluid line, and a valve arrangement distinct from the control valve to control communication to the trapped volume whereby higher pressures can be achieved at lower engine speed and maximum pressures can be controlled at higher engine speed.

2. A pump system according to claim 1 wherein the valve arrangement comprises a valve actuatable by fuel supply pressure.

3. A pump system according to claim 1 wherein the valve arrangement comprises a valve actuatable by a solenoid actuator.

4. A pump system according to claim 1 wherein the valve arrangement comprises a channel in the plunger.

5. A pump system according to claim 4 wherein the trapped volume is an annulus formed in the pump body around the pumping chamber.

6. A pump system according to claims 4 wherein the channel is located to establish fluid communication between the trapped volume and the plunger chamber as the plunger reciprocates between a retracted position and an extended position.

7. A pump system according to claim 6 wherein fluid communication is established at or near the extended position.

8. A pump system according to claim 1 wherein the valve arrangement comprises a spool valve.

9. A pump system according to claim 1 wherein the valve arrangement operates as a pressure-balanced valve.

10. A pump system according to claim 1 wherein the trapped volume is about 500 $mm^3$.

11. A method of controlling the maximum pressure in a pump system for a fuel injector in a diesel engine, the fuel injector having a control valve to control commencement and termination of a fuel injection event, and the pump system having a pump body defining a pumping chamber; a plunger disposed in the pumping chamber for pressurizing fuel; an outlet; and a fluid line connecting the pumping chamber to the outlet, the method characterized by:

establishing communication between the pumping chamber or the fluid line and a trapped volume by a valve arrangement distinct from the control valve as the plunger approaches an extended position.

12. A pump system according to claim 5 wherein the channel is located to establish fluid communication between the trapped volume and the plunger chamber as the plunger reciprocates between a retracted position and an extended position.

13. A pump system according to claim 2 wherein the valve arrangement comprises a spool valve.

14. A pump system according to claim 3 wherein the valve arrangement comprises a spool valve.

15. A pump system according to claim 2 wherein the valve arrangement operates as a pressure-balanced valve.

16. A pump system according to claim 3 wherein the valve arrangement operates as a pressure-balanced valve.

17. A pump system according to claim 1 wherein the trapped volume is an annulus formed in the pump body around the pumping chamber.

18. A pump system for a fuel injection system in a diesel engine, the pump system having:

a pump body defining a pumping chamber;

a plunger disposed in the pumping chamber for pressurizing fuel;

an outlet; and a fluid line connecting the pumping chamber to the outlet; characterized by:

a trapped volume in fluid communication with the pumping chamber or the fluid line, and a valve arrangement to control communication to the trapped volume wherein the trapped volume is an annulus formed in the pump body around the pumping chamber, whereby higher pressures can be achieved at lower engine speed and maximum pressures can be controlled at higher engine speed.

19. A pump system according to claim 18 the valve arrangement comprises a channel in the plunger.

20. A pump system according to claim 19 wherein the channel is located to establish fluid communication between the trapped volume and the plunger chamber as the plunger reciprocates between a retracted position and an extended position.

21. A pump system for a fuel injection system in a diesel engine, the pump system having:

a pump body defining a pumping chamber;

a plunger disposed in the pumping chamber for pressurizing fuel;

an outlet; and a fluid line connecting the pumping chamber to the outlet; characterized by:

a trapped volume in fluid communication with the pumping chamber or the fluid line, and a spool valve actuatable by fuel supply pressure to control communication to the trapped volume, whereby higher pressures can be achieved at lower engine speed and maximum pressures can be controlled at higher engine speed.

* * * * *